United States Patent [19]

Catallo

[11] Patent Number: 5,012,562

[45] Date of Patent: May 7, 1991

[54] COMPRESSIVE SHRINKING APPARATUS UTILIZING AN IMPROVED IMPACT BLADE FOR THE SHRINKING OF FABRIC

[76] Inventor: Frank Catallo, 75 Channel Dr., Port Washington, N.Y. 11050

[21] Appl. No.: 498,537

[22] Filed: Mar. 26, 1990

[51] Int. Cl.[5] ..... D06C 21/00

[52] U.S. Cl. ..... 26/18.6; 26/18.5

[58] Field of Search ..... 26/18.5, 18.6

[56] References Cited

U.S. PATENT DOCUMENTS

| | | | |
|---|---|---|---|
| 2,263,712 | 11/1941 | Wrigley et al. | 26/18.6 |
| 2,765,513 | 10/1956 | Walton | 26/18.6 |
| 2,765,514 | 10/1956 | Walton | 26/18.6 |
| 3,015,145 | 1/1962 | Cohn et al. | 26/18.6 |
| 3,188,837 | 6/1965 | Ondarza et al. | 26/18.5 |
| 3,390,218 | 6/1968 | Painter et al. | 26/18.6 |
| 4,447,938 | 5/1984 | Catallo | 26/18.6 |
| 4,689,862 | 9/1987 | Catallo | 26/18.6 |
| 4,882,819 | 11/1989 | Milligan | 26/18.6 |

*Primary Examiner*—W. C. Reynolds
*Assistant Examiner*—John J. Calvert
*Attorney, Agent, or Firm*—Leo Fornero

[57] ABSTRACT

An improved apparatus for the compressive shrinking of fibrous materials is disclosed. The apparatus uses a system of moving surfaces of different speeds cooperating with a confining blade spaced from the movable surface or surfaces to cooperate to form a stuffing chamber for compaction of the fibrous material. An improved impact blade is provided to facilitate the compression of the fibrous material and the blade includes an apparatus for achieving optimum straightness of the blade among the benefits provided.

16 Claims, 2 Drawing Sheets

COMPRESSIVE SHRINKING APPARATUS UTILIZING AN IMPROVED IMPACT BLADE FOR THE SHRINKING OF FABRIC

FIELD OF THE INVENTION

The invention relates to improvements in an apparatus for the compressive shrinking of a fibrous web material and in particular to an improved impact blade for such apparatus which provides an improved compressive treatment to the fibrous web material.

BACKGROUND OF THE INVENTION

A number of different machines have been proposed to effect a compressive force on fibrous webs in order to impart pre-shrinkage properties to such material. One such apparatus is disclosed in U.S. Pat. Nos. 2,765,513 and 2,765,514 both to Walton which disclose application of compressive forces along short columnar lengths of a fabric. The machine disclosed, for imparting the compressive forces, utilizes two spaced rolls rotating in opposite directions at different speeds and between which a fabric is fed. A fabric indentor forces the fabric into the rubber surface of the faster rotating roll prior to the fabric being fed to the nip between the rolls with the result that a short columnar length of fabric between the indentor and nip is compressed. This apparatus has not been entirely successful in compressing all types of fabrics and in particular those falling into the knit category. In such knit fabrics yarns generally do not extend in lenghtwise or columnar directions; thusly, it becomes difficult to apply a compressive force to these yarns.

Other approaches have also been used to shrink such webs —for example rolls rotating in opposite directions at different speeds but utilizing a compactor shoe spaced from the faster roll rather than fabric indentors. In such instances, the faster moving roll acts as a feed roll to force a fabric material between it and the compactor shoe after which the material is fed to the nip between the rolls where the material is ironed to set the fibers or yarn in place. An example of this type of apparatus is shown in U.S. Pat. No. 3,015,145 to Cohn et al. A problem with apparatus of this type where opposed rolls rotating in opposite directions are utilized, as well as with the same type of apparatus described above using a fabric indentor, is that the faster rotating roll tends to scuff the material in the nip area making it difficult to treat such material uniformly on both sides.

Machines for effecting a compressive force on fibrous material have also utilized pairs of endless belts which are spaced from each other and which move in the same linear direction. The belts used are such that the linear speed of the surface of the belt may be changed by varying belt curvature with the result that when material fed between the belts is to be longitudinally compressed, the spacing between the belts is increased by decreasing the belt thickness which results in the surface speed of the belt being reduced so as to act as a retarding force on the material. The compressive effect utilizing belts however is limited by the belt thickness and construction. Further the belts are relatively expensive and require extensive maintenance.

To overcome certain of these deficiencies an apparatus is disclosed in U.S. Pat. No. 4,363,161 to Catallo wherein a fibrous web is forced into a stuffing chamber formed by a confining member having an apex and two movable surfaces with the apex extending into the space between the movable surfaces.

A further benefit may be achieved by utilizing, in association with the apparatus of U.S. Pat. No. 4,363,161 an impact blade which facilitates the flow of fibrous material around the apex of the confining member. One such apparatus is disclosed in U.S. Pat. No 4,447,938 and the impact blade is of concave guide surface configuration.

It has been found that such concave configuration of the impact blade provides drawbacks during operation as the edge of blade may disfigure the fabric.

Accordingly it is an object of this invention to provide the compressive shrinking apparatus contemplated herein with a new and improved impact blade to reduce substantially any fabric surface defects.

It is therefore another object of this invention to provide a higher grade fabric.

It is a further object of this invention to provide an apparatus for the compressive treatment of a wider variety of fibrous webs.

For a more complete understanding of the above and other features and advantages of the invention, reference should be made to the following detailed description of a preferred embodiment and to the accompanying drawings.

BRIEF DESCRIPTION OF THE DRAWINGS

In the drawings, like reference character denote corresponding parts throughout the several views.

GENERAL DESCRIPTION OF THE INVENTION

Figure 1:
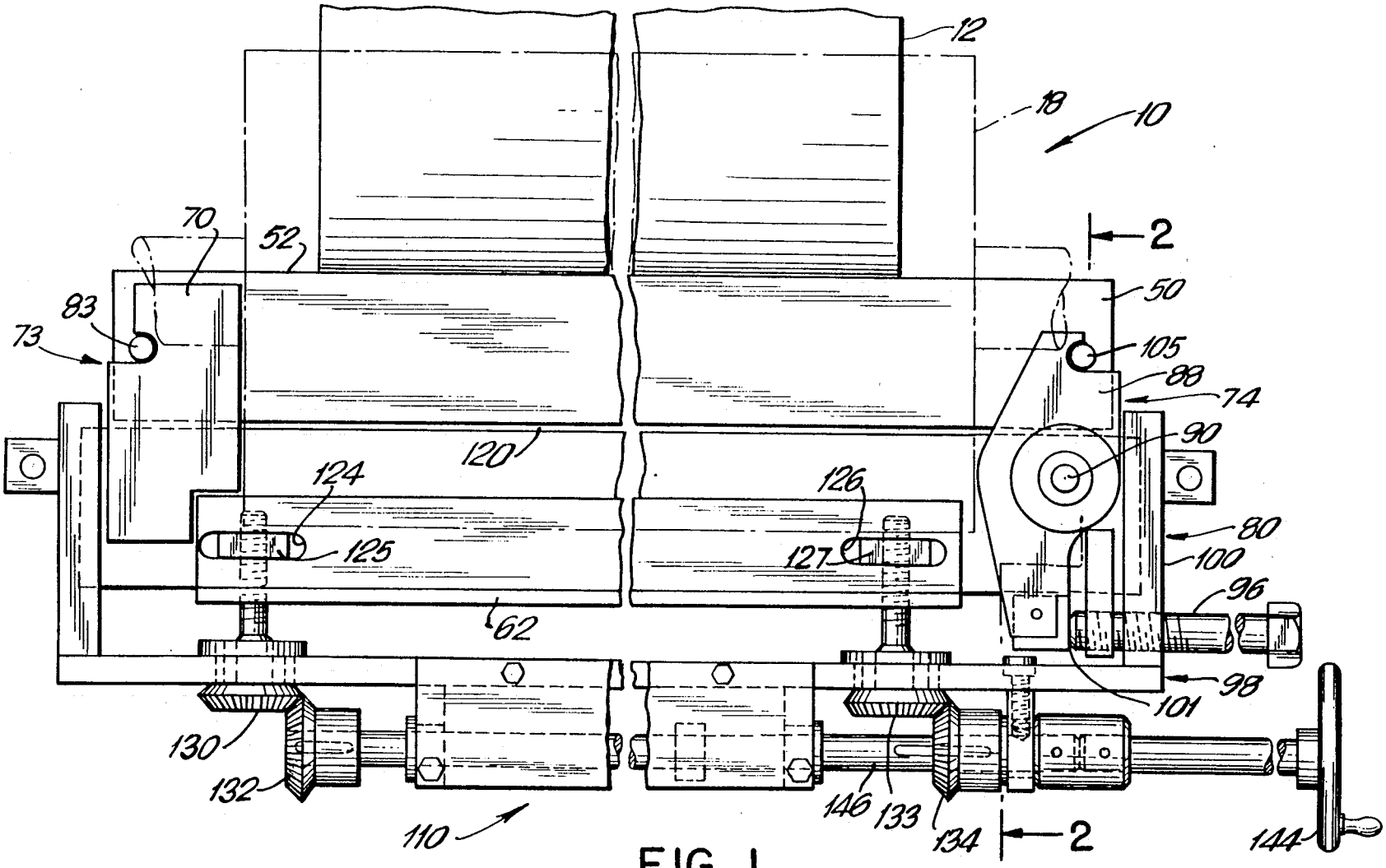
FIG. 1 is a partial side sectional view of an apparatus including the features in accordance with this invention.
Figure 2:
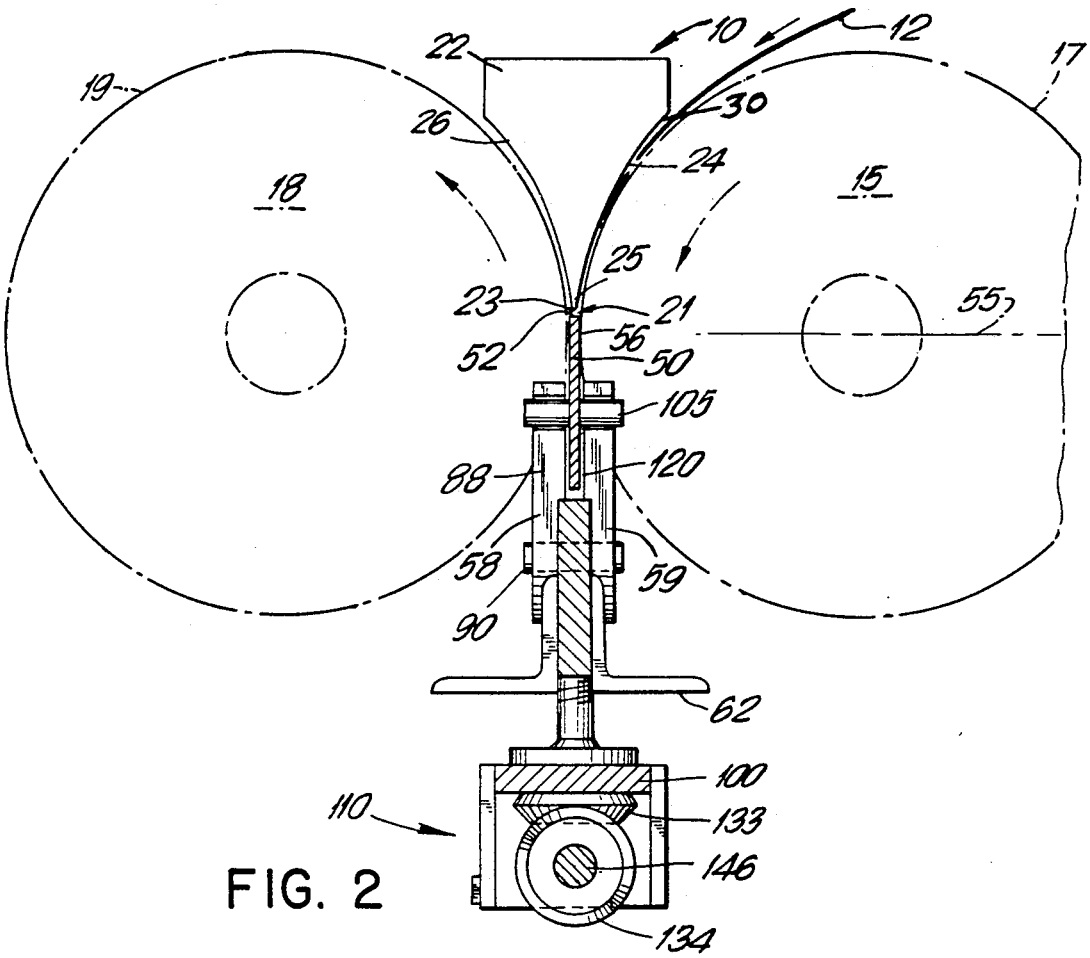
FIG. 2 is a sectional view of an apparatus including the features in accordance with this invention taken on Line 2—2 in FIG. 1.

Referring to FIG. 1, there is shown an apparatus 10 for compressively shrinking a web 12 composed of fibrous material which is fed by a roll 15, as best sown in FIG. 2, having a first uninterrupted surface 17 on its outer periphery and which rotates as shown in FIG. 2, in the direction of the arrow. A roll 18 which has a second uninterrupted surface 19 thereon is positioned adjacent to and spaced from the roll 15. Roll 18 rotates in the same direction as roll 15 as can be seen from the direction of the arrow in FIG. 2, on roll 18. Thusly the surfaces 17 and 19 move in opposite peripheral directions at the roll nip area 21.

Figure 3:
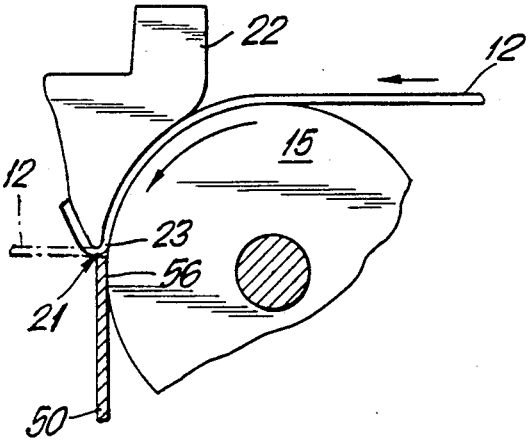
FIG. 3 is a partial sectional view showing the apparatus including a compacting zone of the type which may be utilized with this invention
Figure 4:
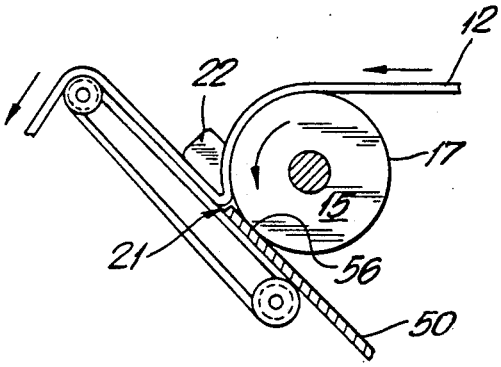
FIG. 4 is a partial sectional view showing a modification of the apparatus contemplated by this invention.

A confining means 22 having wings 24 and 26, as best shown in FIG. 2, join together at the apex 25 and is positioned relative the rolls. As can be seen in the drawings apex 25 of the confining means has a smooth arcuate surface extending between the surface 17 and 19 on the rolls and is directed towards the nip area 21. In U.S. Pat. No. 4,447,938 there is shown an apparatus for adjusting the confining means into and out of nip area 21. Such a provision permits use of the shrinking apparatus on different fabrics having a variety of thicknesses and weights. Additionally the invention may also be utilized in a shrinking apparatus provided with a precompacting zone such as is shown in U.S. Pat. No. 4,689,862 as will be understood by one skilled in this technology. Such an arrangement is shown in FIG. 3. Also while the fabric 12 is shown as flowing in an upward direction the flow after the fabric contacts the blade 50 can be directed in a horizontal or downward path. This flow of the fabric depends on the type of shrinking apparatus the impact blade is associated with. For example in FIG. 4 an arrangement is provided wherein the flow of the fabric is upward but can easily be downwardly or horizontal by manipulating the components forming the compaction chamber which functions like the stuffing chamber. Additionally the benefits of aligning the blade 50 as set forth herein may apply to a movable surface in combination with a confining means alone or a cooperating member such as is shown in FIG. 4 to form a compaction chamber or member with which the blade 50 functions to achieve the objectives stated herein.

As shown in FIG. 2, The fibrous web 12 prior to being compressively shrunk is fed by roll 15 through the space 30 between roll 15 and wing 24 into the stuffing chamber 23. Roll 18 rotates at a slower speed than roll 15 so that it imparts a retarding force on the web of material 12. This results in longitudinal compressive forces being exerted on the web of material from approximately the point where the web enters the stuffing chamber and the point where the web exits the stuffing chamber. Further insight in connection with the operation of the apparatus for compressively shrinking the web of material may be obtained from U.S. Pat. No. 4,363,161.

Where greater shrinkage compression is required, the fabric must be compacted to a greater amount in the stuffing chamber formed between the moving surface and the confining means. Under high fabric compression forces the fabric tends to be forced into the nip area between the moving surfaces instead of around the apex with the result that the web will not flow at a relatively fast speed into the chamber and at a slower speed out of the chamber. In order to prevent this from occurring an impact blade having a concave surface is shown in U.S. Pat. No. 4,363,161 and accomplishes the intended function.

However I have found that presenting an edge to the web such as is found on a concave blade or one that is disposed relative the fabric at an angle to also present an edge to same causes a problem known as two sidedness. More particularly the edge rubbing against the fabric causes the fabric to take on different appearance from that on the other side—this is particularly noticeable in darker fabrics.

Additionally I have uncovered that during operation of compressive shrinking apparatus utilizing an impact blade as described hereinabove there is a tendency for the impact blade to lose its straightness usually after the blade becomes hot after a period of operation which may vary depending on the type fabric being treated. This usually causes blade distortion and deflection as heat develops during the compacting process. Attempts have been made to cure these distortions of the blade through the application of localized pressure points, as by tightening screws at desired locations along the length of the blade—this is more of a convenience or an accommodation than a cure which overcomes the problem.

What I have discovered is an approach to overcome this problem by reducing the differential in temperature between the top and bottom of the blade which creates the distortion causing the loss of straightness which has the result of a loss of fabric compaction efficiency.

This is accomplished, as is best shown in FIG. 1, by having an impact blade 50 supported at each end on pins 105 and 83 attached to the blade. In FIG. 2 blade 50 is shown as being disposed at one edge 52 to extend into the stuffing chamber 23 and beyond the horizontal center line 55 of the roll 15. It is also contemplated that at the edge 52 the blade is disposed in tangential relationship as at 56 with one of the movable surfaces 17 or 19. The blade 50 has pins 83 and 105 attached at either of its ends and is supported by clips 70 and lever 88. Note the space 120 formed around the bottom and sides of the blade 50 acts as an insulator to reduce the heat which would be greater if there was contact between the support structure and the blade as will be understood by those skilled in the art.

The pin members 58 and 59 engage with clips 70 and 88 which are mounted on T-member 62. Thusly there is provided a means for minimizing the heat transfer which would be substantially greater if direct contact occurred between the blade and supporting structure. Additionally minimum support is achieved by mounting the stretching means only at each of the ends thereof as can be seen in FIG. 1. More particularly a clip 70 is mounted at one end 73 of the support structure, generally designated 80, which comprises the T-member 62 and includes the clips 70 and 88 in a fashion to hold the blade in proper position in the compacting zone. At the other end 74 of the blade, means are provided to support the blade 50 in similar fashion to those at end 73 except that the lever clip 88 is mounted on the member 80 and pinned at 90 so that it will pivot, normally to place the impact blade in tension to cooperate with the other support member at end 73 to maintain a straight blade during operation when under conditions which cause distortion and deflection.

In this fashion a blade configuration in keeping with the objectives of this invention, of providing a fabric web contacting surface which is straight and at right angles to the vertical axis of the blade, is achieved.

In order to maintain these conditions as specified above it is desired to enable an operator to make adjustments which become necessary due to the rigors of operating. An arrangement for tensioning the blade comprises a bolt 96 mounted in one end 98 of a housing 100 which also functions to act as a supporting structure for moving the blade vertically into and out of the stuffing chamber. The bolt 96 abuts the bottom edge 101 of clip 88 which on rotation of bolt 96 will pivot at pin 90 to tension the blade by stretching same by acting against pin 105.

A manual arrangement 110 is provided for leveling and moving the impact blade into and out of the stuffing chamber. This arrangement as shown in FIG. 1 comprises plate angle members mounted on the support structure 100 in any well known manner which will be clear from the drawings. Slots 124 and 126 are provided in the plate angle members and in which are disposed nut and bolt ends 125 and 127. At the opposite ends there are fashioned gears 130 and 133. Gears 132 and 134 are disposed at the end of the operating arrangement to drive gears 130 and 133. In similar fashion bolt and nut 127 is disposed in the slot 126 and includes a gear 133 cooperating with a gear 134 also mounted on the manual operating arrangement to drive gear 133 to move the blade into and out of the stuffing chamber. This is accomplished by rotating the hand wheel 144 in a pre-determined direction. Additionally provisions are included for detaching the shaft 146 so that it will function to selectively operate one or the other bolt arrangements 125 or 127. The slots are about the same size as the nuts of the bolts 125 and 127 in the vertical dimension. It should be understood of course that specific forms of the invention herein illustrated and described are intended to be representative only as certain changes may be made in the invention without departing from the clear teachings of the disclosure. Accordingly, reference should be made to the following appended claims determining the full scope of the invention.

I claim:

1. An apparatus for the compressive treatment of a fibrous material comprising:

(a) a movable surface, (b) means for moving said movable surface in a predetermined direction and at a predetermined rate of speed, (c) a confining means for said apparatus spaced from said movable surface and functioning with same to form a compaction chamber into which said fibrous material is adapted to be moved by the movable surface and from which the fibrous material is adapted to be moved by said apparatus, (d) an impact blade extending into said compaction chamber for facilitating the compression of said fibrous web, (e) said impact blade of a predetermined length; and (f) said impact blade being provided with a surface for contacting the fibrous web perpendicular to the vertical axis of the blade and said contacting surface being flat.

2. The apparatus according to claim 1 wherein the fibrous material contacting surface of the impact blade lies above the center line of said movable member.

3. The apparatus according to claim 2 wherein the impact blade includes means for stretching same to achieve optimum straightness thereof.

4. The apparatus according to claim 3 wherein the device for holding the impact blade at one end and the device for tensioning the impact blade at the other end are both adapted to minimize contact with the blade in order to reduce distortion thereof from excessive heat.

5. The apparatus according to claim 4 wherein the means for stretching the impact blade comprises a device for holding one end of the impact blade in a fixed and supported position and a second device for tensioning the impact blade at the other end thereof.

6. An apparatus for the compressive treatment of a fibrous material comprising:

(a) a movable surface, (b) means for moving said movable surface in a predetermined direction and at a predetermined rate of speed, (c) a cooperating means for said apparatus and spaced from said movable surface, (d) a confining means for said apparatus also being spaced from said movable surface and functioning with same and said cooperating means to form a compaction chamber into which said fibrous material is adapted to be moved by the movable surface and from which the fibrous material is adapted to be moved by the cooperating means, (e) an impact blade extending into said compaction chamber for facilitating the compression of said fibrous web, (f) said impact blade of a predetermined length; and (g) said impact blade being provided with a surface for contacting the fibrous web perpendicular to the vertical axis of the blade and said contacting surface being flat.

7. The apparatus according to claim 6 wherein the fibrous material contacting surface of the impact blade lies above the center line of said movable member.

8. The apparatus according to claim 7 wherein the impact blade includes means for stretching same to achieve optimum straightness thereof.

9. The apparatus according to claim 8 wherein the means for stretching the impact blade comprises a device for holding one end of the impact blade in a fixed and supported position and a second device for tensioning the impact blade at the other end thereof.

10. The apparatus according to claim 9 wherein the device for holding the impact blade at one end and the device for tensioning the impact blade at the other end are both adapted to minimize contact with the blade in order to reduce distortion thereof from excessive heat.

11. An apparatus for the compressive treatment of a fibrous material comprising:

(a) a first movable surface, (b) means for moving said first movable surface in a first direction at a first rate of speed, (c) a second movable surface spaced from said first movable surface, (d) means for moving said second movable surface in a second direction opposite to said first direction at a second rate of speed slower than said first rate of speed, (e) a confining means spaced from said first and second movable surfaces having an apex extending between and towards said surfaces to form a stuffing chamber therewith into which fibrous material is adapted to be moved by said first movable surface and from which fibrous material is adapted to be moved by said second movable surface, (f) an impact blade extending into said stuffing chamber for guiding flow of fibrous material around said apex, (g) said impact blade of a predetermined length; and (h) said impact blade being provided with a surface for contacting the fibrous web perpendicular to the vertical axis of the blade and said contacting surface being flat.

12. The apparatus according to claim 11 wherein said impact blade is in tangential relationship with at least one of said movable surfaces.

13. The apparatus according to claim 12 wherein the fibrous material contacting surface of the impact blade lies above the center line of said movable member.

14. The apparatus according to claim 13 wherein the impact blade includes means for stretching same to achieve optimum straightness thereof.

15. The apparatus according to claim 14 wherein the means for stretching the impact blade comprises a device for holding one end of the impact blade in a fixed and supported position and a second device for tensioning the impact blade at the other end thereof.

16. The apparatus according to claim 15 wherein the device for holding the impact blade at one end and the device for tensioning the impact blade at the other end are both adapted to minimize contact with the blade in order to reduce distortion thereof from excessive heat.

* * * * *